US008375638B2

(12) United States Patent
Martin et al.

(10) Patent No.: US 8,375,638 B2
(45) Date of Patent: Feb. 19, 2013

(54) SLIDING PANEL SYSTEM

(75) Inventors: Guillaume Martin, Rochetoirin (FR); Venugopal R. Ghatikar, Salt Lake City, UT (US); Christopher A Luomanen, San Francisco, CA (US); Jeremy Porter, Salt Lake City, UT (US); William Gatti, Sandy, UT (US); Brian Hillstrom, Loretto, MN (US); R. Talley Goodson, Salt Lake City, UT (US)

(73) Assignee: 3form, Inc., Salt Lake City, UT (US)

( * ) Notice: Subject to any disclaimer, the term of this patent is extended or adjusted under 35 U.S.C. 154(b) by 0 days.

(21) Appl. No.: 13/269,869

(22) Filed: Oct. 10, 2011

(65) Prior Publication Data

US 2012/0031008 A1 Feb. 9, 2012

Related U.S. Application Data

(62) Division of application No. 11/575,893, filed as application No. PCT/US2007/063907 on Mar. 13, 2007.

(60) Provisional application No. 60/782,178, filed on Mar. 14, 2006, provisional application No. 60/888,819, filed on Feb. 8, 2007.

(51) Int. Cl.
*E05D 15/06* (2006.01)

(52) U.S. Cl. ..... 49/409; 49/501; 49/410; 49/411

(58) Field of Classification Search ..... 49/409, 49/410, 411, 501; 52/787.1, 364; 312/7.2, 312/138.1, 139.2
See application file for complete search history.

(56) References Cited

U.S. PATENT DOCUMENTS

| | | | | | |
|---|---|---|---|---|---|
| 394,774 | A | * | 12/1888 | Kling | 49/409 |
| 855,352 | A | | 5/1907 | Smith et al. | |
| 2,845,846 | A | | 8/1958 | Kelleher | |
| 3,052,930 | A | | 9/1962 | Mathews | |
| 3,075,255 | A | | 1/1963 | Taubman | |
| 3,309,816 | A | | 3/1967 | Malone et al. | |
| 3,562,956 | A | | 2/1971 | Johnson et al. | |
| 3,861,444 | A | | 1/1975 | Portwood | |
| 4,183,179 | A | | 1/1980 | Gutridge et al. | |
| 4,467,562 | A | | 8/1984 | Hemmerling | |
| 4,914,770 | A | | 4/1990 | Baus | |
| 4,998,304 | A | | 3/1991 | Sauter | |
| 5,351,442 | A | * | 10/1994 | Gingras | 49/411 |
| 5,471,791 | A | * | 12/1995 | Keller | 49/317 |
| 6,052,867 | A | * | 4/2000 | Haab et al. | 16/87.6 R |

(Continued)

FOREIGN PATENT DOCUMENTS

| | | | |
|---|---|---|---|
| DE | 199 46 170 | * | 4/2001 |
| EP | 0235290 A1 | | 9/1987 |

(Continued)

OTHER PUBLICATIONS

Furniture Fittings and Applications US stocking Catalog, Author Unknown, Published by Hettich FurnTech GmbH & Co. KG, Germany, Copyright Feb. 2006, 286 pgs. [online] [retrieved on Aug. 13, 2007]. Retrieved from the Internet: http://www.hettichamerica.com/hus/PDF/Catalog/HUS_2006.pdf.

(Continued)

*Primary Examiner* — Gregory J. Strimbu
(74) *Attorney, Agent, or Firm* — Workman Nydegger

(57) ABSTRACT

A roller door system includes a roller assembly configured to mount directly to a panel and move along a complementary upper guide. In particular, the roller assembly can be coupled to a coupling member embedded in the panel. The roller assembly, when coupled with the panel, can provide a smooth gliding motion for the panel.

20 Claims, 7 Drawing Sheets

U.S. PATENT DOCUMENTS

| | | | | |
|---|---|---|---|---|
| 6,497,072 | B2 | 12/2002 | Fries | |
| 6,826,867 | B1 * | 12/2004 | McDonald et al. | 49/213 |
| 6,834,401 | B2 | 12/2004 | Hatrick-Smith | |
| 7,080,490 | B2 * | 7/2006 | Horn et al. | 52/309.7 |
| 7,743,557 | B2 | 6/2010 | Liao | |
| 2006/0150518 | A1 * | 7/2006 | Van 't Zelfde et al. | 49/409 |
| 2006/0230683 | A1 * | 10/2006 | Hung | 49/409 |
| 2006/0230684 | A1 * | 10/2006 | Poole | 49/409 |

FOREIGN PATENT DOCUMENTS

| | | | |
|---|---|---|---|
| EP | 0 487 956 | * | 6/1992 |
| JP | 2002138772 | A | 5/2002 |
| KR | 100883579 | B1 | 2/2009 |

OTHER PUBLICATIONS

USPTO, Office Action mailed Dec. 8, 2011 in U.S. Appl. No. 11/575,893, 12 pages.

USPTO, Office Action mailed Aug. 16, 2011 in U.S. Appl. No. 11/575,893, 7 pages.

USPTO, Office Action in U.S. Appl. No. 11/575,893, mailed May 10, 2012, 14 pages.

USPTO, Office Action in U.S. Appl. No. 13/269,869, mailed May 16, 2012, 15 pages.

USPTO, Office Action in U.S. Appl. No. 11/575,893, mailed Nov. 28, 2012, 16 pages.

* cited by examiner

SLIDING PANEL SYSTEM

CROSS-REFERENCE TO RELATED APPLICATIONS

The present application is a divisional of U.S. patent application Ser. No. 11/575,893, filed on Oct. 2, 2007, which is a U.S. National Stage Patent Application corresponding to PCT Application No. PCT/US07/63907, filed on Mar. 13, 2007, which claims the benefit of priority to U.S. Provisional Patent Application No. 60/782,178, filed on Mar. 14, 2006, entitled "Face Mounted Roller Door System," and to U.S. Provisional Patent Application No. 60/888,819, filed on Feb. 8, 2007, entitled "Ceiling Mounted Roller Door System." The entire content of each of the above-mentioned applications is incorporated by reference herein.

BACKGROUND OF THE INVENTION

1. The Field of the Invention

This invention relates to systems and methods related to mounting resin panels to a ceiling, wall, or floor structure as a door, wall or other form of movable divider.

2. Background and Relevant Art

Some recent architectural designs have implemented synthetic, polymeric resins, which can be used as partitions, walls, décor, etc., in offices and homes. Present polymeric resin materials generally used for creating these resin panels comprise F polyvinyl chloride or "PVC"; polyacrylate materials such as acrylic, and poly (methylmethacrylate) or "PMMA"; polyester materials such as poly (ethylene-co-cyclohexane 1,4-dimethanol terephthalate), or "PET"; poly (ethylene-co-cyclohexane 1,4-dimethanol terephthalate glycol) or "PETG"; glycol modified polycyclohexylenedimethlene terephthalate; or "PCTG"; as well as polycarbonate materials.

In general, resin materials such as these are now popular compared with decorative cast or laminated glass materials, since resin materials can be manufactured to be more resilient and to have a similar transparent, translucent, or colored appearance as cast or laminated glass, but with less cost. Decorative resins can also provide more flexibility compared with glass at least in terms of color, degree of texture, gauge, and impact resistance. Furthermore, decorative resins have a fairly wide utility since they can be formed to include a large variety of artistic colors, images and shapes.

As mentioned above, one particular use of decorative resins can be in the panel form, where the panel might be used as a door, wall, or other form of space divider. In the case of a door, there are many conventional ways to mount the door to a ceiling or wall. In particular, a manufacturer or assembler can take a resin panel and attach the resin panel to a ceiling or wall using a sliding, hinged, or pivoting based hardware. Unfortunately, it can be fairly difficult to mount a resin panel in such a position using conventional mounting hardware, and in a way that allows the resin panel to also display its aesthetic properties adequately. For example, conventional mounting hardware typically does not provide an appropriate attachment interface that can be readily hidden or blended with respect to the decorative resin panel.

In addition, conventional mounting hardware tends to be either too large in size, or too complex in configuration to be used with efficiency. For example, the size and configuration of conventional door attachment hardware does not often provide such functional features as height and pitch adjustment. Furthermore, the configuration of conventional mounting hardware tends to result in an attachment that can be fairly noisy when providing sliding or pivoting functions. In addition, the size and configuration of conventional mounting hardware makes such hardware difficult to mount to a given resin panel for use as a door without at least partially hindering the intended aesthetic of the resin panel.

Furthermore, there does not presently exist any sliding door hardware that fully frames and accommodates flexible resin panels generally, as well as some of the unique challenges associated with resin panels. For example, conventional sliding door hardware and frame/glazing systems are typically designed to accommodate glass. As glass is a fairly rigid material, the glass itself provides significant structural stability when used as a door or as a sliding partition. The rigidity of the glass also means that in a fully framed condition, the depths of the frame channels do not need to be substantial (e.g., in depth or width). When using a flexible resin, however, particularly PETG, the shallower depths and widths that might ordinarily be used for glass panels are generally inadequate to fully retain a resin panel (e.g., made of PETG, or even polycarbonate, acrylic, etc.) and accommodate the inherent expansion and contraction of the resin material.

Accordingly, an advantage can be realized with systems and components that provide for a relatively simple and smooth motion, and that preserves an intended aesthetic in a decorative architectural environment.

BRIEF SUMMARY OF THE INVENTION

Implementations of the present invention provide systems, components, and methods for mounting a panel (e.g., a resin panel) as a door or divider, so that the panel can move, glide, or slide in an efficient manner, while preserving an intended aesthetic for the panel. In particular, implementations of the present invention include the incorporation of one or more frame components to be mounted about a panel, and further include one or more ceiling or face-mount apparatus that can be rollably or slidably coupled to the frame.

For example, in at least one implementation, a roller door system for mounting one or more resin panels in a retractable, slidable door or divider configuration, can include an upper guide, as well as a resin panel secured within a panel frame. The system can also include a roller assembly mounted to the panel frame on one end and positioned within the upper guide on an opposing end. In this case, the roller assembly is configured to roll through the upper guide. In addition, the system can include a lower track configured to guide the door panel along a support surface.

In an additional or alternative implementation, an adjustable door frame assembly configured to provide an efficient sliding motion for a panel along a support surface can include a resin panel having a gauge. The door frame assembly can also include a plurality of frame components mounted on at least two opposing edges of the resin panel, including an upper edge and a lower edge of the resin panel. In addition, the door frame assembly can include an adjustable roller assembly mounted directly to one of the plurality of frame components on one end, and inserted within an upper guide mounted to a ceiling substrate. Furthermore, the door frame assembly can include a brake assembly positioned within the upper guide, where the brake assembly is configured to reduce the speed of a resin panel, and to hold the resin panel in a stopped position.

Furthermore, a method of assembling a ceiling mounted roller door system can involve mounting a plurality of frame components about a panel, where the plurality includes at least an upper frame component. The method can also include mounting an upper guide to a ceiling or wall substrate. In addition, the method can include mounting at least one roller assembly directly to the upper frame component on one end of the at least one roller assembly, and positioning a rolling portion of the at least one roller assembly within the upper guide. Furthermore, the method can include adjusting the at least one roller assembly with respect to the upper component until a distance between a support surface and a lower portion of the panel exceeds a minimum distance.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, components, and methods for mounting a panel (e.g., a resin panel) as a door or divider, so that the panel can move, glide, or slide in an efficient manner, while preserving an intended aesthetic for the panel. In particular, implementations of the present invention include the incorporation of one or more frame components to be mounted about a panel, and further include one or more ceiling or face-mount apparatus that can be rollably or slidably coupled to the frame.

As will be appreciated more fully herein, these components, when coupled or mounted to the resin panel, can provide the ability to mount a panel as a door, divider, or other form of movable enclosure, and at the same time provide that panel with a smooth gliding motion. The smooth gliding motion provided by these components is aided not only by framing and roller assembly components, but also by the components used to stabilize the panel in a particular frame. In particular, implementations of the present invention also include a number of components that can be used to frame virtually any gauge of a panel, and further to accommodate the given panel's unique expansion and contraction properties. Specifically, these mounting/framing components can be configured to ensure the given panel cannot easily wiggle or slip out of the frame over time.

As a preliminary matter, frequent reference herein is made to mounting of a panel, such as a resin panel. One will appreciate from the following specification and claims, however, that implementations of the present invention can be applied broadly not only to resin-based panels, such as polycarbonates, copolyesters, acrylics, or mixtures thereof, but also to non-resin based panels, such as those based partly or entirely from glass or glass composites. Accordingly, reference herein to resin panels, as such, is made primarily by way of convenience in description or illustration.

Figure 1A:
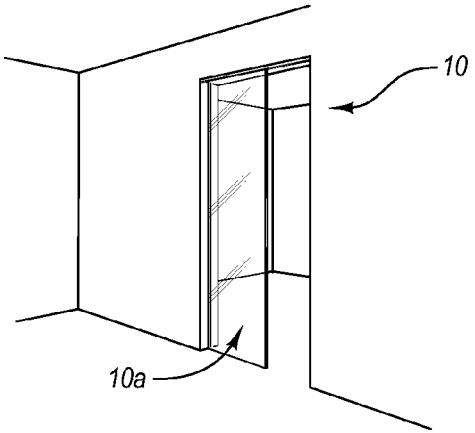
FIG. 1A illustrates a schematic diagram of an internally-framed door configured using one or more components in accordance with one or more implementations of the present invention.

Referring now to the Figures, FIGS. 1A-1D illustrate various implementations in accordance with the present invention in which panels can be mounted in a door or divider system 10 using the system(s), component(s), and apparatus described herein. For example, FIG. 1A illustrates an implementation of door system 10 that has been prepared or mounted as a "pocket door" 10*a*. In this implementation, the roller-based pocket door 10*a* comprises a resin panel with the frames and mounting apparatus mounted primarily inside a substrate of an internal wall opening (or internal door frame opening). In at least one implementation, for example, the pocket door 10*a* includes an upper guide and optional lower track) mounted on the inside of the wall substrate, as well as extending inside and outside the door frame. The mounting thus allows a user to slide the door into a partly or completely concealed (or open) position within the wall, or to slide the door into a completely or partially closed position.

Figure 1B:
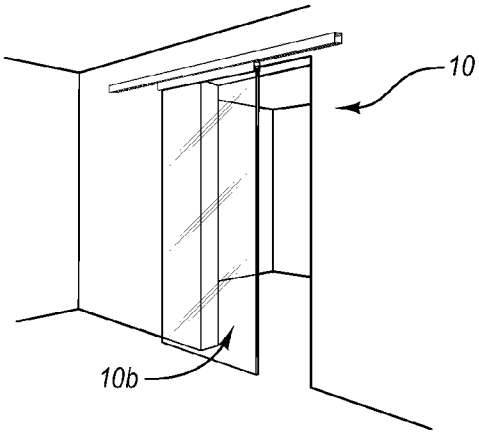
FIG. 1B illustrates a schematic diagram of a wall mounted door configured using one or more components in accordance with one or more implementations of the present invention.

FIG. 1B illustrates a general "door" implementation 10*b*, in which the upper guide and optional lower track) is mounted on a wall substrate. In this implementation, the door system 10*b* is constructed so that the framed panel component of the door is always visible from at least one side of the wall on which the framed panel is mounted. The user can then slide the door 10*b* along the upper guide and optional lower track) in front of or away from a wall opening (e.g., door frame) as necessary.

Figure 1C:
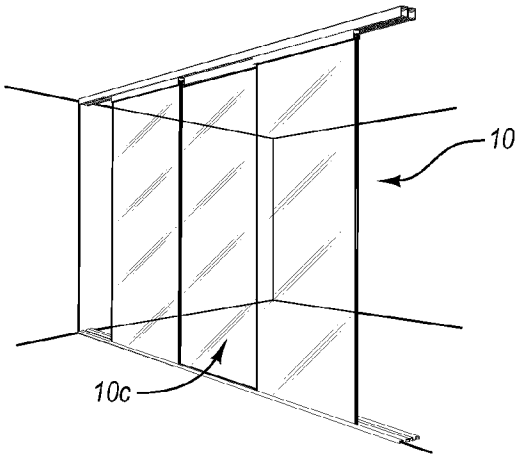
FIG. 1C illustrates a schematic diagram of a ceiling mounted door configured using one or more components in accordance with one or more implementations of the present invention.

In addition, FIG. 1C illustrates another implementation of a roller-door 10, where the door is used as a multi-panel "divider" 10*c* using an upper guide mounted directly to an overhead/ceiling substrate. In at least one implementation, this configuration can allow for multiple bypassing doors. For example, a user can mount a plurality of framed panels within the upper guide and optional lower track) in any combination of fixed or slidable mountings. The user can then mount many or most of the panels in a fixed position to resemble a stationary wall, and then subsequently mount fewer than all of the framed panels in more mobile positions as one or more doors. In another implementation, the user can mount all of the panels as slidable panels, such that the user can move any or all of the panels in a door capacity. For multiple bypassing doors, the tracks may simply be placed directly next to one another (e.g., ¼" of spacing therebetween) without fear of the framed panels interfering with one another.

Figure 1D:
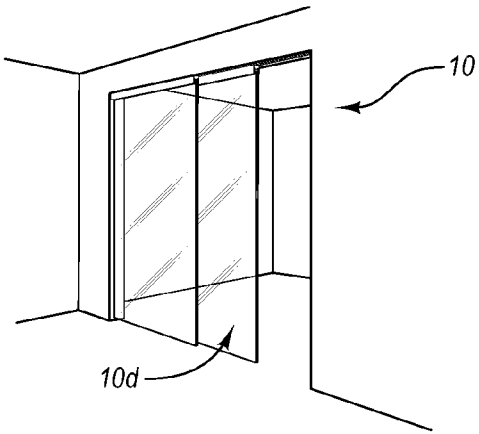
FIG. 1D illustrates a multiple door configuration using one or more components in accordance with one or more implementations of the present invention.

FIG. 1D illustrates still another implementation of the roller door system 10, in which the user has mounted the upper guide and optional lower track) within a door frame as a "bypassing door" 10*d*. In this implementation, the user has not mounted the upper and optional lower) track inside the wall, but mounted the track(s) primarily (or exclusively) within the visible part of the door frame. Thus, upon mounting the door panel in the appropriate tracks, the user can move any or both of the panels along the corresponding tracks as doors. In contrast with the pocket door 10*a* implementation, the user of the bypassing door 10*d* would not necessarily conceal the framed panel within a wall.

Figure 2B:
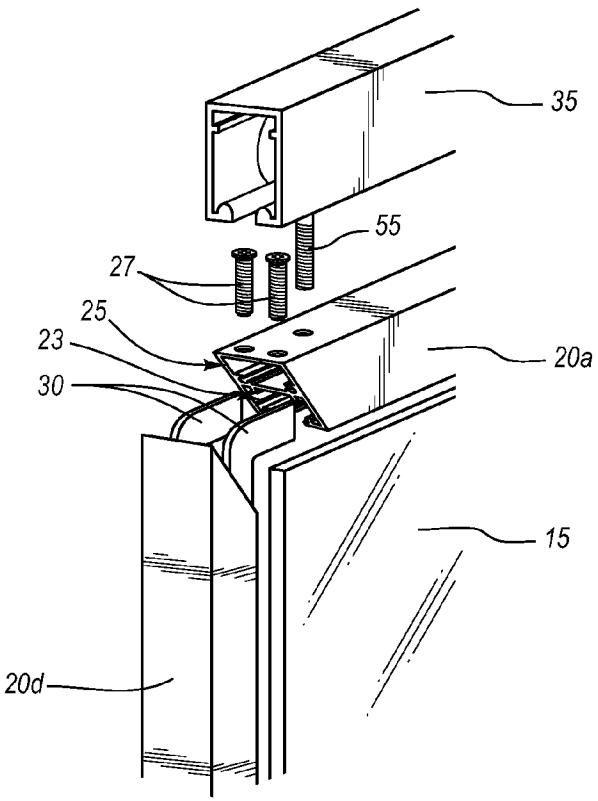
FIG. 2B illustrates an exploded view of a joint between frame components of the frame shown in FIG. 2A.
Figure 2A:
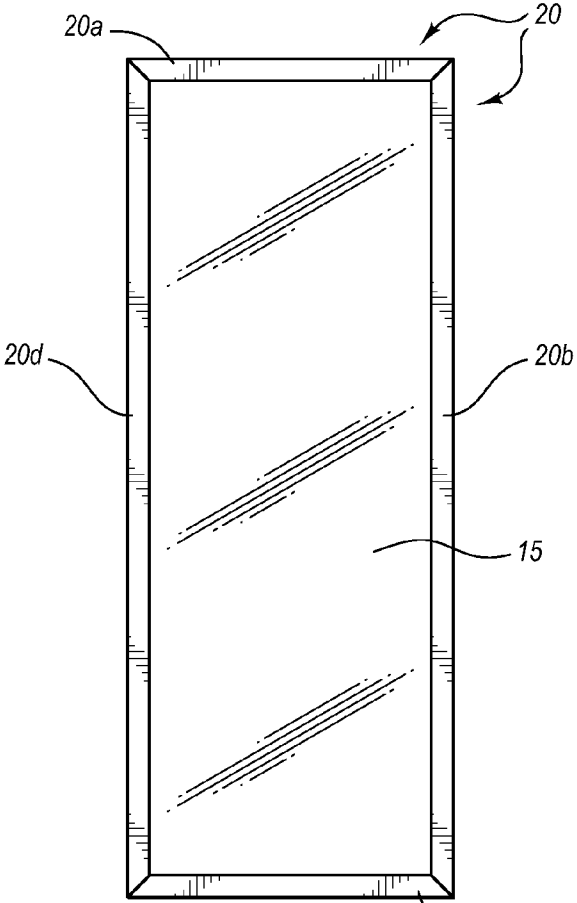
FIG. 2A illustrates a facing view of a framed panel in accordance with an implementation of the present invention.

FIG. 2A illustrates an example of a panel as it has been mounted to a frame in accordance with an implementation of the present invention. For example, FIG. 2A shows that a panel 15 to be used as a divider or door can be mounted on one or more sides by a frame 20 having frame components 20*a-d*. In general, FIG. 2A shows that frame 20 comprises upper frame component 20*a*, side frame components 20*b* and 20*d*, and lower frame component 20*c*. One will appreciate that each such component of the frame 20, however, is essentially the same construction, and is only differentially designated by its position on the resin panel 15. In general, one will appreciate that each frame component can be made from virtually any material that is sufficiently strong and aesthetically pleasing to accomplish the ends set forth herein. For purposes of illustration, however, at least one implementation of a material for frame 20 can comprise anodized aluminum, which can complement the panel 15 material without detracting from the overall appearance of thereof.

In any event, FIG. 2B illustrates an exploded view of a joint between frame components 20*a* and 20*d* shown in FIG. 2A. For example, FIG. 2B shows that panel 15 is mounted on a left side by side frame component 20*d*, and on a top or upper side by upper frame component 20*a*. FIG. 2B also shows that upper frame component 20*a* comprises lower or receiving portion 23, as well as an upper or mounting portion 25. Thus, in this particular case, FIG. 2B shows that the receiving portion 23 receives an extreme edge of panel 15, while the upper or mounting portion 25 is mounted directly or indirectly to a track, such as upper guide 35.

To facilitate mounting between frame components 20*a* and 20*d*, FIG. 2B shows that a pair of angled (e.g., L-shaped) mounting bars 30 are mounted within and otherwise extend from frame component 20*d*. In one implementation, the manufacturer or assembler positions the receiving portion 23 of frame component 20*d* against an edge of panel 15. The manufacturer or assembler then inserts mounting bars 30 into corresponding receptacle(s) in receiving portion 23 of frame component 20*a*, and further mounts frame component 20*a* against the upper edge of panel 15.

The manufacturer or assembler then secures frame components 20*a* and 20*d* using the one or more fasteners 27 positioned through one or more tappings. In at least one implementation, the one or more fasteners 27 are threaded, and the manufacturer or assembler simply rotates fasteners 27 into a corresponding tapping or other form of receptacle in frame component 20*a*. In one implementation, the manufacturer or assembler can first tap the frame components 20*a* and 20*d*, as necessary, to receive fasteners 27. As discussed more fully in FIGS. 3A-B and 4A-B, the manufacturer or assembler may also position one or more gaskets 37*a*, 37*b* within receiving portion 23 of a given frame component. The mounting bars and threaded fasteners, therefore, particularly when applied at each end of each frame 20 component about the panel 15, can securely hold panel 15 in position within frame 20.

In contrast with the secure mounting between frame components 20*a* and 20*d*, FIG. 2B also shows that the manufacturer or assembler can mount the upper frame component 20*a* to the upper guide 35 in a generally less-restricted fashion. In particular, and as shown in more detail with respect to FIG. 3, a manufacturer or assembler can mount upper guide 35 to upper frame component 20*a* via one or more adjustable hanger bolts 55 of a roller assembly (hidden in FIG. 2B). Since the roller assembly is adjustable, a manufacturer or assembler can connect or mount the upper guide 35 and upper frame component 20*a* in a manner that is appropriate for a wide range of ceiling/floor and panel height dimensions.

Figure 3B:
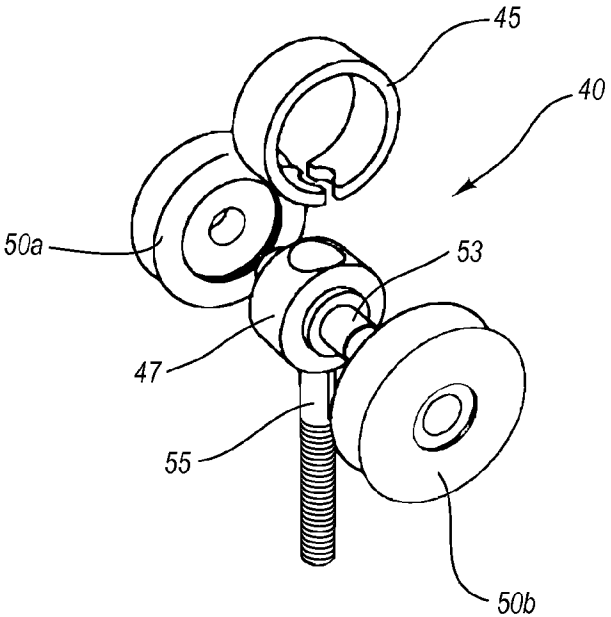
FIG. 3B illustrates an exploded view of the roller assembly shown in FIG. 3A.
Figure 3A:
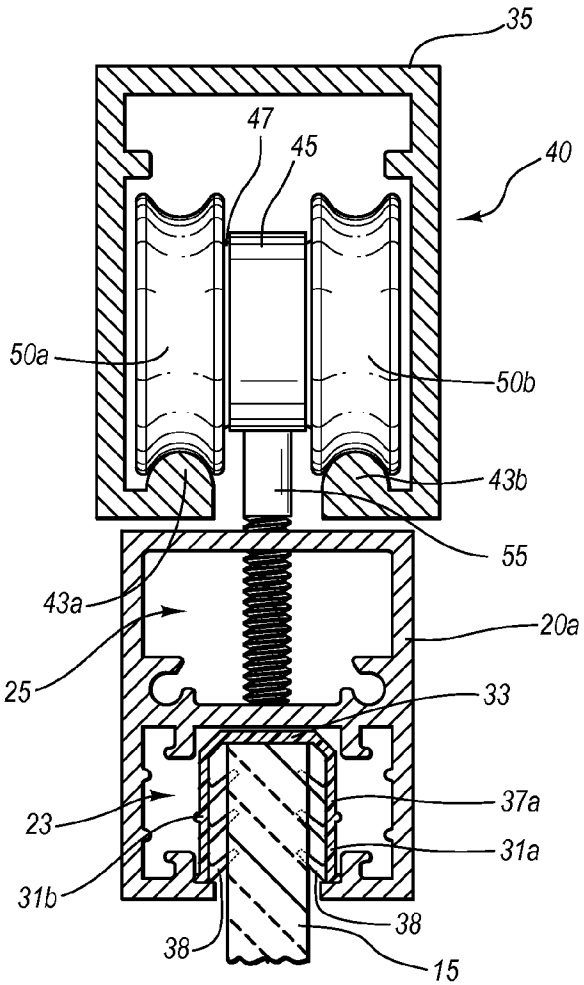
FIG. 3A illustrates a facing cross-sectional view of a roller assembly inserted in an upper guide in accordance with an implementation of the present invention.

For example, FIG. 3A illustrates a facing cross-sectional view of an adjustable (e.g., at least vertically) roller assembly 40 that has been inserted in upper guide 35, and further mounted to upper frame component 20*a*. In particular, FIG. 3A illustrates that adjustable roller assembly 40 (e.g., a vertically adjustable roller assembly) can comprise at least a set of rollers 50*a* and 50*b*, which are configured to fit or otherwise roll over a set of rails 43*a* and 43*b*, respectively, positioned or formed in upper guide 35. As shown in the exploded adjacent view, FIG. 3B further illustrates that adjustable roller assembly 40 comprises a central mounting member 47 through which both hanger bolt 55 and axle 53 are inserted.

In one implementation, central mounting member 47 comprises at least a first hollow portion through which hanger bolt 55 can be inserted. FIG. 3B also shows that central mounting member 47 comprises at least a second hollow portion through which axle 53 can be inserted. In addition, FIG. 3B shows that hanger bolt 55 can also comprise a hollow portion (not shown), such that axle 53 is seen extending from one side of hanger bolt 55 to an opposing side. Furthermore, the exploded view of FIG. 3B shows that central mounting member 47 can be covered with a center clamp 45, which can help stabilize each of components 47, 53, and 55 during use.

Accordingly, at least one method of assembly includes a manufacturer or assembler mounting hanger bolt 55 within central mounting member 47. In at least one implementation, the upper end of hanger bolt 55 is threaded, and the central mounting member 47 is reciprocally-threaded for receiving hanger bolt 55, to thereby accomplish the mounting. In addition, the method of assembly can involve the manufacturer or assembler inserting axle 53 through central mounting member 47 and hanger bolt 55. Furthermore, the method can involve the user mounting rollers 50*a-b* on respective axle 53 ends, and positioning adjustable roller assembly 40 about rails 43*a* and 43*b* of upper guide 35.

Upon assembling the adjustable roller assembly 40 within upper guide 35, the manufacturer or assembler can then mount hanger bolt 55 to frame component 20*a* to suspend frame component 20*a* (and panel 15) from upper guide 35. For example, FIG. 3A shows that hanger bolt 55 extends downward and is mounted directly into upper frame component 20*a*. As previously mentioned, hanger bolt 55 can be threaded at the mounting end. In such a case, the manufacturer or assembler can then screw the mounting end of hanger bolt 55 into a threaded tapping or other form of threaded receptacle in upper frame component 20*a*. In another implementation, hanger bolt 55 can be mounted to frame component 20*a* using other forms of mounting means, including any number or form of snap-fit means. For example, frame component 20*a* can comprise a receptacle with a set of horizontally-extending, vertically-spaced ridges or grooves (e.g., 56, FIG. 6) therein. The ridges, in turn, are configured to receive a correspondingly ridged hanger bolt (not shown), which can interlock with the receptacle ridges or grooves at any number of vertical points.

In addition, hanger bolt 55 can be threaded in a variety of different ways as well. For example, hanger bolt 55 can comprise rotatable portions, so that a lower threaded portion can be rotated or screwed into frame component 20*a*, while an upper portion of adjustable roller assembly 40 remains relatively fixed within central mounting member 47. In additional or alternative implementations, hanger bolt 55 is a single threaded member, whereby a manufacturer or assembler screws hanger bolt 55 into upper frame component 20*a* before completing adjustable roller assembly 40. To make vertical adjustments, the upper guide 35 and rollers 50*a*, 50*b* can be configured in size and shape so that the manufacturer or assembler may simply lift the panel 15 off of rails 43. The manufacturer or assembler can then rotate the hanger bolt (and entire adjustable roller assembly 40 within guide 35) as appropriate, and lower panel 15 so that the rollers 50*a*, 50*b* rest again on rails 43.

Figure 4B:
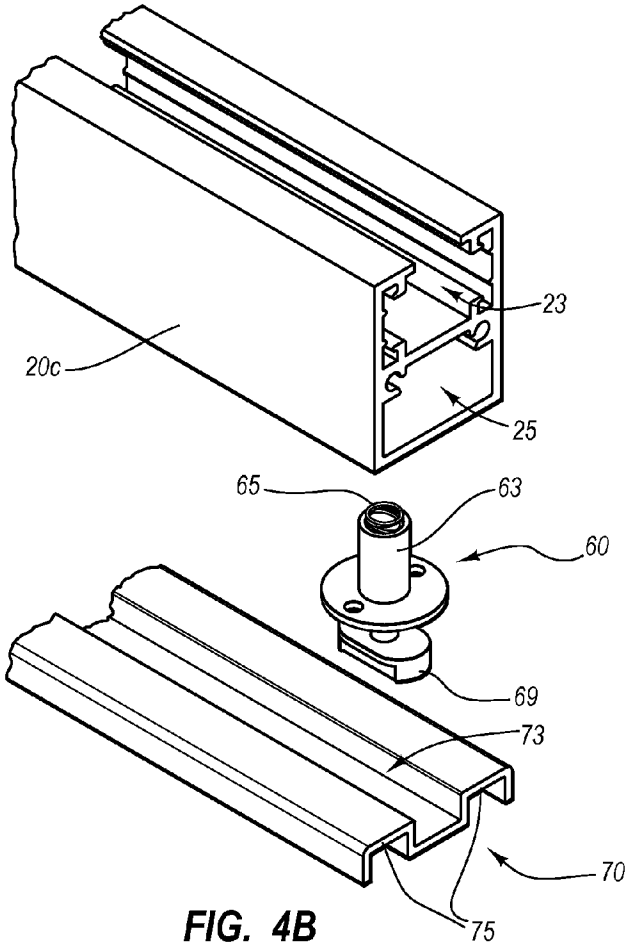
FIG. 4B illustrates an exploded view of the lower track assembly of FIG. 4A.

In either case, the variability by which a manufacturer or assembler can mount hanger bolt 55 inside upper frame component 20*a* provides a great degree of flexibility for accommodating different ceiling/floor heights and/or panel heights. Beyond the adjustability of hanger bolt 55, however, FIGS. 3A-B and 4A-B further show still additional components that can be used not only to stabilize frame 20 about panel 15, but also to ensure a smooth sliding motion of door 10. For example, the facing view of FIG. 3A shows that frame component 20*a* can further include a gasket 37*a*. In addition, FIGS. 4A-B illustrate additional mechanisms for providing an adjustable, smooth gliding surface.

Referring to gasket 37*a*, FIG. 3A illustrates that gasket 37*a* (also 37*b*, FIG. 4), can be inserted in receiving portion 23. In general, gasket (e.g., 37*a-b*) can be configured to ensure a stabilized mounting interface for panel 15 within a given frame component, regardless of panel dimension. For example, resin panels are typically manufactured to vary in gauge from as thin as about ⅛" (one-eighth inch) or ¼" (one quarter inch), or thinner, to as thick as about 1½" (one and one-half inches) to about 2" (two inches), or thicker, depending on the end-user's designs. In general, thicker gauges tend to be sturdier and more expensive) than thinner gauges with respect to conventional panel frames or mounts. In accordance with the present invention, however, frame 20 and gasket 37*a*, 37*b* can be used with sufficient stability on thinner panel 15 gauges, such as anywhere from about ¼" (one-quarter inch) to about ⅜" (three-eighths inch). In particular, implementations of the present invention allow use of a thinner, potentially more cost-effective, panel without sacrificing panel rigidity or deflection resistance.

To at least partly enable this sturdier, more stabilize mount, FIG. 3A shows that gasket 37*a* comprises a u-shaped body including opposing legs 31*a*, 31*b*, and a back 33. The gasket 37*a* further includes a set of opposing ridges 38 extending from the opposing legs toward the back 33. The ridges 38 can be configured to grip opposing surfaces of panel 15. In general, a manufacturer or assembler can modify different gaskets to have different lengths of ridges 38 for different panel gauges. In at least one implementation, however, the manufacturer or assembler uses the same gasket 37*a* with the same ridges 38 for each gasket. Gasket 37*a* and corresponding ridges 38, in turn, are configured with at least partly flexible, yet sufficiently rigid, material configured to receive and hold virtually any size or gauge of panel 15 (or any contraction/expansion thereof). For example, gasket 37*a* can comprise any resiliently-deformable natural or synthetic materials, including rubber, latex, flexible plastics, or combinations thereof.

Figure 4A:
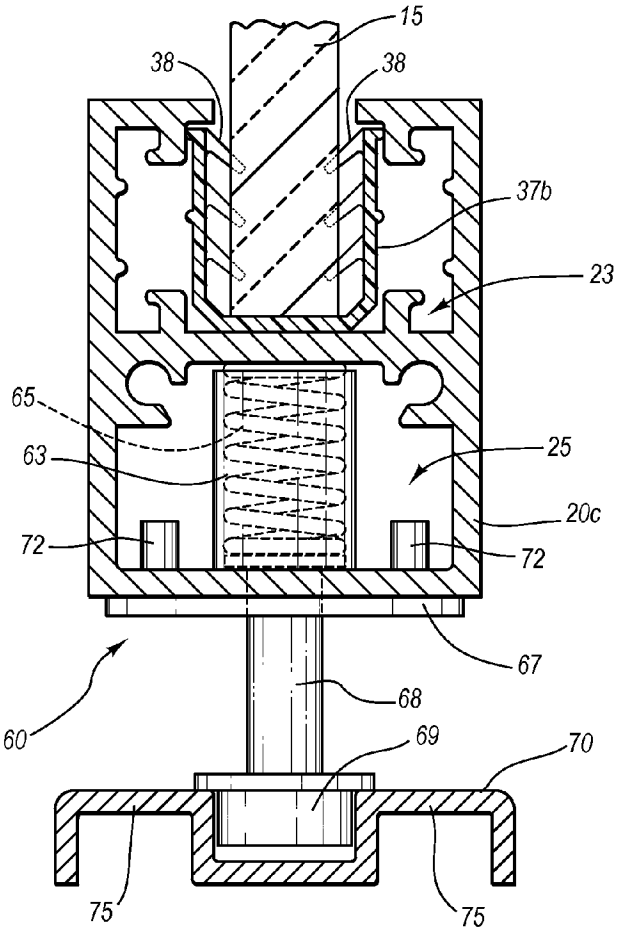
FIG. 4A illustrates a facing cross-sectional view of a lower track assembly in accordance with an implementation of the present invention.

FIG. 4A also shows inclusion of gasket 37*b* in receiving portion 23 of frame component 20*c*. In FIG. 4A, however, frame component 20*c* is oriented in essentially the reverse or opposite position as that shown in FIG. 3A, since frame component 20*c* is positioned in this case at the bottom (e.g., near the floor or support surface) of panel 15. As with the discussion with respect to FIG. 3A, however, gasket 37*b* serves essentially the same purpose for stabilizing panel 15 in the relevant frame component. FIGS. 4A-B also show that frame component 20*c* can be mounted to or positioned about a lower track or guide 70 via one or more resilient guiding means or resilient guides 60. The one or more resilient guiding means or resilient guides 60, in turn, are configured to accommodate variations in panel or flooring dimension, as well as provide a smooth, even motion of a given door 10.

To this end, FIGS. 4A and 4B show that the one or more resilient guiding means or resilient guides 60 can comprise a housing 63 having one or more spring components 65 inserted therein. Guiding means or resilient guide 60 can also comprise a post 68 slidably inserted within housing 63, and directly adjacent spring 65. In addition, FIGS. 4A and 4B show that guiding means or resilient guide 60 can comprises one or more slides 69 configured for insertion and/or sliding within slot 73 of track 70.

Therefore, a manufacturer or assembler may first tap frame component 20*c* (if a tap/receptacle is not already present) to provide a receptacle within receiving portion 25. The manufacturer or assembler can then insert housing 63 into the tapping or receptacle of receiving portion 25, and further insert spring 65 (and post 68) within housing 63. The manufacturer or assembler can then fasten plate 67 directly to the surface of frame component 20*c*. In at least one implementation, the manufacturer or assembler can position several such guiding means 60 at any number of points along the surface of frame component 20*c*, as needed or appropriate for operation. The resulting spring-loaded guide and track system can ensure that a sliding panel is able to move efficiently, despite any variations in flooring, or support surface.

One will appreciate that additional other components (not shown) can also be used in accordance with lower or bottom track 70 to move or hold a panel. For example, in additional or alternative implementations, a manufacturer or assembler can also position a simple floor guide (rather than components 60 and 70) for limited travel applications, as well as a floor bolt option. The manufacturer or assembler can also use a keyed-lock to hold a door in a specific position, as well as use track end coverings to cover the extreme ends of track 70. When used with pocket door 10*a*, the manufacturer or assembler may also include a wall bumper.

Figure 5B:
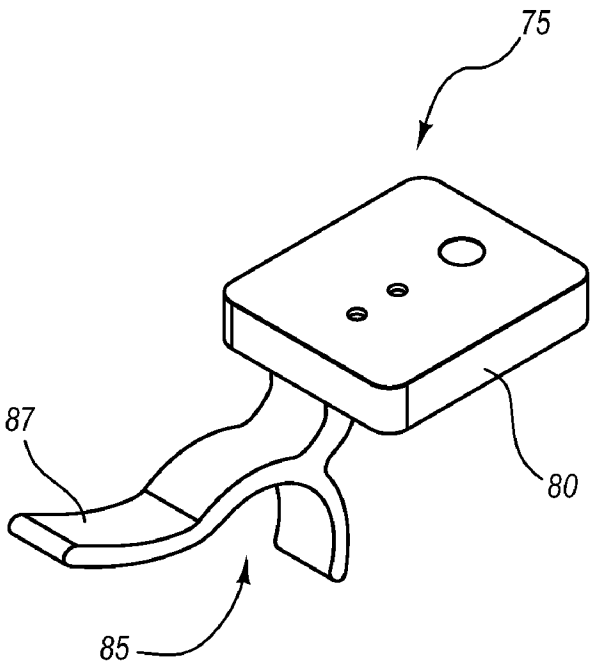
FIG. 5B illustrates an isolated perspective view of the brake assembly shown in FIG. 5A.
Figure 5A:
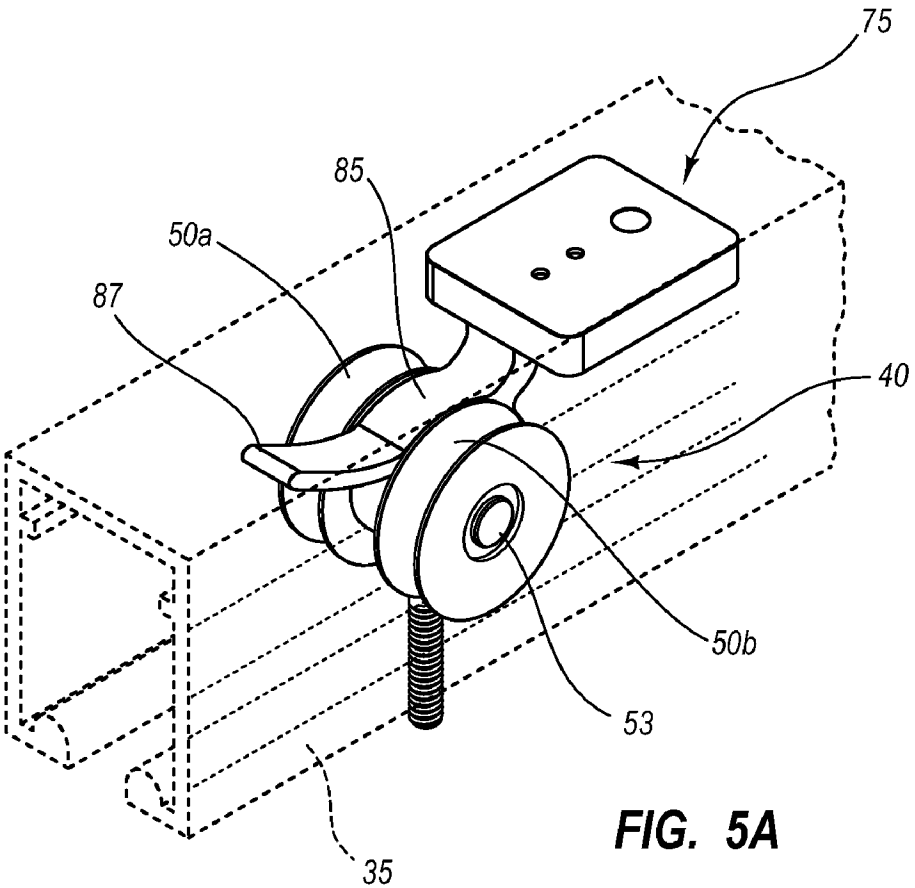
FIG. 5A illustrates a side perspective view of an upper guide and roller assembly when engaged with a brake assembly in accordance with an implementation of the present invention.

Along these lines, implementations of the present invention further provide one or more components and mechanisms for efficiently holding or stopping a door using a brake assembly in upper guide 35. As shown in FIGS. 5A and 5B, for example, a brake assembly 75 for use in stopping adjustable roller assembly 40 within upper guide 35 comprises at least base 80, as well as arcuate stop 85 connected thereto. FIGS. 5A and 5B further show that brake assembly 75 can include a decelerator arm 87 extending outwardly from arcuate stop 85.

In at least one implementation, a manufacturer or assembler of a roller door system 10 inserts brake assembly 75 at one or more extreme ends of upper guide 35, or wherever in guide 35 that braking is needed. The manufacturer or assembler can then secure base portion 80 therein against the upper inside surface of track 35, wherein the arcuate stop 85 and decelerator arm are positioned to receive adjustable roller assembly 40. In at least one implementation, brake assembly 75 is configured or formed so that decelerator arm 87 does not touch the upper inside surface on which base portion 80 is mounted. In at least some cases, for example, a resulting gap between the upper inside surface of track 35 allows decelerator arm 87 to flex upward a degree, as discussed more fully below.

In particular, FIG. 5A shows that decelerator arm 87 extends in a sloping direction from one point with respect to arcuate stop 85 to another. In FIG. 5A, for example, decelerator arm 87 extends above an "uppermost" point (e.g., arc point closest to the surface on which base 80 is mounted) of arcuate stop 85 to a position below the uppermost point of arcuate stop 85. One will appreciate, however, that the position of brake assembly 75 could be reversed in some configurations, such that reference herein to the "uppermost" point of arcuate stop 85 can be reversed to the "lowermost" point in other implementations. In any event, FIG. 5A also shows that arcuate stop 85 can be configured in at least one implementation to conform at least partly to the shape of center clamp 45 on adjustable roller assembly 40. For example, the arcuate stop 85 can be configured in semi-circular form, and in a specific position, such that center clamp 45 of adjustable roller assembly 40 fits snugly within arcuate stop 85.

As such, decelerator arm 87 and arcuate stop 85 are formed so that, when adjustable roller assembly 40 approaches, decelerator arm 87 first comes into contact with center clamp 45. The downward bias force from decelerator arm 87 causes adjustable roller assembly 40 to gradually reduce speed. At the same time, the opposing force of center clamp 40 causes decelerator arm 87 to flex upwardly toward the upper inside surface of track 35. The upward flexing of decelerator arm 87 allows center clamp 45 to move into position directly against arcuate stop 85, at which point decelerator arm 87 settles back into the initial position. When decelerator arm 87 settles into the initial position, the decelerator arm 87 and arcuate stop 85 of brake assembly 75 can effectively hold adjustable roller assembly 40 until a user supplies sufficient force in the opposite direction to flex decelerator arm 87 upwardly again.

In operation, the components of brake assembly 75 provide a smooth and secure stopping motion for a given panel door, with minimal stress applied on the panel door. In particular, the components of brake assembly 75 are configured to slow and stop a panel door in motion without many of the "bounce back" effects sometimes seen with conventional door stops, which could potentially loosen the panel within a given frame 20. Furthermore, the design of the brake assembly 75 allows virtually any user to move the panel door in and out of the stopped position without much difficulty or required force.

Figure 6:
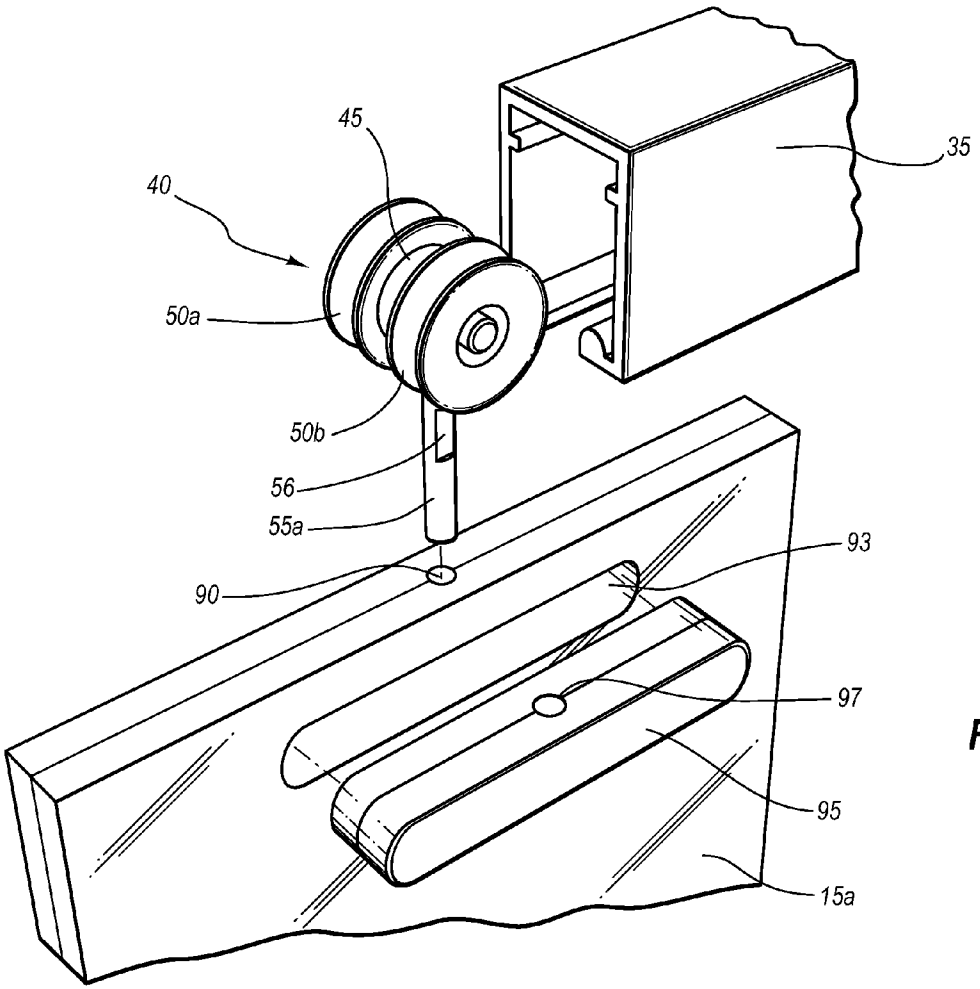
FIG. 6 illustrates an alternative configuration in accordance with an implementation of the present invention in which a panel is mounted to a roller assembly without the use of an upper frame component.

In addition to the foregoing, FIG. 6 illustrates yet another alternative configuration in accordance with an implementation of the present invention. In particular, FIG. 6 illustrates a configuration in which panel 15*a* is mounted to roller assembly 40 directly, rather than via an upper frame component (e.g., 20*a*). To this end, FIG. 6 shows that roller assembly 40 can comprise an alternate hanger bolt 55*a*, which is configured to interlock directly to panel 15*a* via embedded coupling member 95.

In the illustrated implementation, hanger bolt 55*a* comprises at least one set of grooves 56 that can be used for a snap fit into embedded coupling member 95, although this is not required. For example, hanger bolt 55*a* can comprise multiple sets of grooves 56 that can be used for vertical snap-fit adjustments within embedded coupling member 95. In such a case, a user could insert or adjust roller assembly 40 within panel 15*a* simply by pushing roller assembly 40 downward or pulling roller assembly 40 upward through panel mounting hole 90 and the coupling mounting hole 97 with sufficient force to engage or disengage the snap interlock. Furthermore, rather than being configured for a snap fit as illustrated, the coupling mounting hole 97 of embedded coupling member 95 can alternatively be configured for receiving a threaded end of a hanger bolt (e.g., hanger bolt 55, FIGS. 3A-3B). In such a case, the manufacturer or assembler can simply rotate hanger bolt 55 and/or assembly 40, as previously described, in or out of the panel mounting hole 90 and the coupling mounting hole 97 as desired for the necessary vertical adjustment.

Accordingly, at least one method of assembly involves a manufacturer or assembler preparing panel 15*a* by creating one or more panel mounting holes 90 for receiving hanger bolt 55*a*. The method also involves the manufacturer or assembler preparing panel 15*a* with one or more cavities 93 so that panel 15*a* can receive one or more corresponding coupling members 95. For example, the manufacturer or assembler can bevel, rout, or drill one or more cavities 93, which are configured in size and shape to reciprocally receive or embed coupling member 97. The manufacturer can then embed coupling member 95 into cavity 93, and further adjustably insert hanger bolt 55*a* (or hanger bolt 55, as appropriate) through panel mounting hole 90 and into coupling mounting hole 97. The manufacturer or assembler can then make any vertical adjustments necessary (where allowable based on the configuration of the hanger bolt), and insert rollers 50*a*-50*b* within upper guide 35.

Figure 7B:
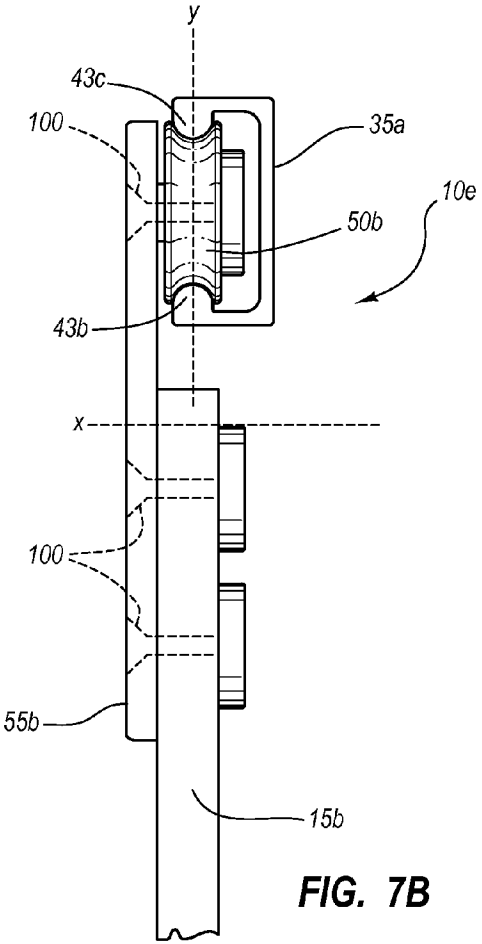
FIG. 7B illustrates a side view of the panel and roller assembly configuration of FIG. 7A.
Figure 7A:
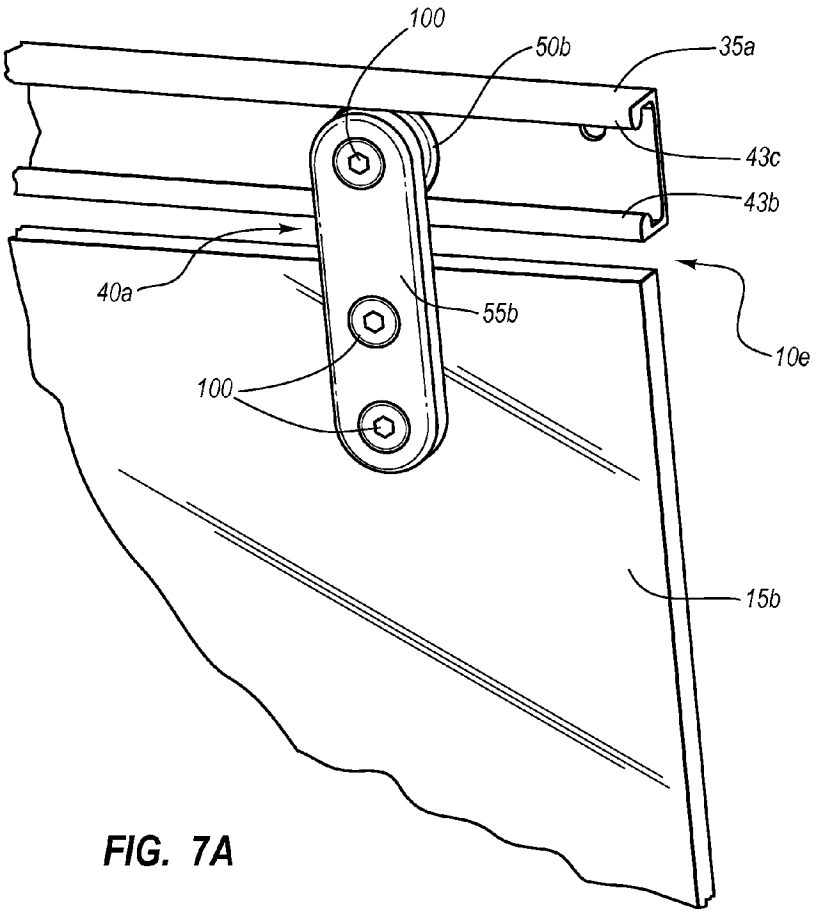
FIG. 7A illustrates a perspective facing view of still another alternative configuration in accordance with an implementation of the present invention in which a panel is mounted in a face-mounted roller assembly.

FIG. 7A illustrates a perspective facing view of still another alternative configuration in accordance with an implementation of the present invention. In particular, FIGS. 7A-7B illustrate one or more components for mounting a given panel 15*b* in a face-mounted roller door configuration 10*e*, rather than necessarily in upper guide 35 for a ceiling mount configuration (e.g., 10*a*-10*d*). For example, FIG. 7A illustrates an alternative upper guide 35*a*, which will generally be mounted to a wall, or ceiling support structure from a side or facing mount. In this case, upper guide 35*a* comprises opposing rails 43*b* and 43*c*, which are configured to guide roller 50*b* of roller assembly 40*a*. Accordingly, one will appreciate that upper guides 35 and 35*a* comprise alternative forms of upper guide means.

FIG. 7A also shows that roller assembly 40*a* comprises a plurality of mounting points 100, such as a mounting point within an axle (not shown) of roller 50*b*, as well as mounting points directly within the side of panel 15*b*. Each of these mountings 100, in turn, can be threaded (e.g., prior to mounting) within hanger bracket 55*b* to couple roller 50*b* and panel 15*b* together, and suspend the panel 15*b* from guide 35*a*. Accordingly, one will appreciate that hanger bolts 55, 55*a*, and hanger bracket 55*b* comprise different forms of suspension means that can be used to couple a given panel (15, 15*a*, 15*b*) to alternative forms of roller assembly means (40, 40*a*, etc.).

In general, there may be any number of reasons why a manufacturer will prefer to mount panel 15 in a face-mounted configuration rather than a ceiling-mounted configuration, and vice versa. For example, as with the configuration of FIG. 6, the face-mounted configuration 10*e* can be prepared in some cases with or without frame 20 (and without any or all of frame components 20*a-d*). In addition, ceiling mount structures may be limited or impractical (e.g., too high) in some environments, thus necessitating a face or wall-mount implementation.

Beyond these reasons, FIG. 7B illustrates that at least one additional advantage of the face-mounted implementation includes the orientation of panel 15 with respect to the given roller assembly. In particular, FIG. 7B shows that the configuration of bracket 55*b*, roller 50*b* and mountings 100 allow panel 15 to be mounted directly or substantially within the same vertical axis ("y") as roller 50*b*. In at least one implementation, this particular mounting along the same vertical axis can ensure that the panel 15 can be moved along upper guide 35*a* without necessarily requiring a corresponding lower track (or track type component). In particular, at least in part since panel 15 is mounted on the same vertical axis as roller 50*b*, there is less tendency for panel 15 to sway during motion.

Accordingly, FIGS. 1A-7B and the corresponding text, therefore, specifically show, describe or otherwise provide a number of systems, components, apparatus, and methods for efficiently mounting, moving, or holding a movable door system. In addition to these, however, one will appreciate that implementations of the present invention can further include additional components for other functionality of a given door 10 system. For example, implementations of the present invention also include mullion extrusions (e.g., as part of frame 20) that can be used to divide a panel 15 into segments. Implementations of the present invention can also include one or more edge locks for securing bypassing and pocket doors 10*a* to a side wall, and a catch set for hooking multiple panels 15 together (e.g., with doors 10*c*). In addition, implementations of the present invention can include one or more handle apparatus, including a handle pull for pocket doors 10*a*, and components to implement a simple finger pull.

One will appreciate, therefore, that the components described herein are simple to assemble, and can provide an elegant interface that can turn virtually any type of panel into a door that, in turn, can attach and slide relative to a wall with efficiency, lack of noise, and with excellent aesthetic characteristics. As such, the wide range of component configurability and general use ensures that a panel made of virtually any material, particularly one made of resin materials, can be easily used as part of a rolling or gliding door system, even in the presence of atypical ceiling/floor dimensions, or atypical panel gauges, etc. Furthermore, the versatility in size and configuration of the framing and mounting apparatus ensure that a door can be mounted to a ceiling, or wall, or even concealed within a ceiling or wall, thus allowing the panel to be used as virtually any type of rolling/gliding door or divider (movable or stationary).

The present invention may be embodied in other specific forms without departing from its spirit or essential characteristics. For example, the components described herein can also be modified so that the door panel is mounted on a ceiling track, rather than on a wall mounted track. Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A roller door assembly, comprising:

an upper guide;

a frameless resin panel including a top edge, opposing side edges, and a bottom edge;

a panel mounting hole extending into resin of the resin panel, the panel mounting hole extending from the top edge of the resin panel toward the bottom edge;

a coupling member embedded within the resin panel, the coupling member being spaced from the top edge of the resin panel such that a portion of the resin panel vertically between the top edge of the resin panel and the coupling member abuts against a top surface of the coupling member, the coupling member having a longitudinal axis that extends perpendicular to a longitudinal axis of the panel mounting hole;

a coupling mounting hole extending into the coupling member; and a roller assembly including a suspension mechanism secured in the coupling mounting hole of the coupling member, the roller assembly being rollably associated with the upper guide;

wherein one or more rails of the upper guide direct the resin panel along a path defined by the upper guide via one or more rollers of the roller assembly.

2. The roller door assembly as recited in claim 1, wherein the suspension mechanism comprises a hanger bolt.

3. The roller door assembly as recited in claim 2, further comprising an axle inserted through the hanger bolt, the axle bearing one or more wheels of the roller assembly.

4. The roller door assembly as recited in claim 2, wherein the hanger bolt is directly secured to the coupling member.

5. The roller door assembly as recited in claim 2, wherein the hanger bolt comprises a groove configured to interlock with the coupling member.

6. The roller door assembly as recited in claim 1, further comprising a brake assembly mounted within the upper guide.

7. The roller door assembly as recited in claim 6, wherein the brake assembly comprises an arcuate stop connected to a base, the arcuate stop having a decelerator arm extending therefrom, wherein the arcuate stop is configured to prevent the roller assembly from moving forward and backward along the upper guide when the roller assembly engages the arcuate stop.

8. The roller door assembly as recited in claim 7, wherein the decelerator arm is configured in size and shape to flex from an initial position to a subsequent position upon contact with the roller assembly and return to the initial position when the roller assembly is positioned against the arcuate stop.

9. The roller door assembly as recited in claim 1, wherein the resin panel is positioned substantially directly vertically below the upper guide.

10. The roller door assembly as recited in claim 1, wherein the top edge, the opposing side edges, and the bottom edge are exposed.

11. A roller door assembly, comprising:

an upper guide securable to a support surface;

a roller assembly rollably mounted to the upper guide;

a frameless resin panel having a top edge, a bottom edge, and opposing side edges, wherein two or more of the top edge, the bottom edge, and the opposing edges are exposed;

a coupling mounting hole extending into resin of the resin panel, the coupling mounting hole having a longitudinal axis that extends in a direction perpendicular to at least one of the opposing side edges of the resin panel, wherein the coupling mounting hole is positioned between the top edge and the bottom edge of the resin panel such that resin portions of the resin panel vertically separate the coupling mounting hole from the top edge and the bottom edge of the resin panel;

a panel mounting hole extending into the top edge of the resin panel and extending toward the bottom edge;

a coupling member secured in the coupling mounting hole in the resin panel, the coupling member having a longitudinal axis that extends parallel to the longitudinal axis of the coupling mounting hole; and a suspension mechanism coupled to the roller assembly and the coupling member.

12. The roller door assembly as recited in claim 11, wherein each of the top edge, the bottom edge, and the opposing side edges are exposed.

13. The roller door assembly as recited in claim 11, wherein the suspension mechanism extends into the panel mounting hole in the top edge of the resin panel.

14. A system, comprising:

an upper support;

a frameless resin panel including a top edge, opposing side edges, and a bottom edge;

a panel mounting hole extending into resin of the resin panel, the panel mounting hole extending from the top edge of the resin panel toward the bottom edge;

a coupling member embedded within the resin panel, the coupling member being spaced from the top edge of the resin panel such that a portion of the resin panel vertically between the top edge of the resin panel and the coupling member abuts against a top surface of the coupling member, the coupling member having a longitudinal axis that extends perpendicular to a longitudinal axis of the panel mounting hole;

a coupling mounting hole extending into the coupling member; and a suspension mechanism secured in the coupling mounting hole of the coupling member, the suspension mechanism further being coupled to the upper support to suspend the resin panel from the upper support.

15. The system as recited in claim 14, wherein the top edge, the opposing side edges, and the bottom edge are exposed.

16. The system as recited in claim 14, wherein the suspension mechanism comprises a hanger bolt.

17. The system as recited in claim 16, wherein the hanger bolt comprises a groove configured to interlock with the coupling member.

18. The system as recited in claim 16, wherein the hanger bolt is directly secured to the coupling member.

19. The system as recited in claim 14, further comprising:

a roller assembly coupled to the suspension mechanism, the roller assembly being rollably associated with the upper support;

wherein one or more rails of the upper support direct the resin panel along a path defined by the upper support via one or more rollers of the roller assembly.

20. The system as recited in claim 14, wherein the resin panel is positioned substantially directly vertically below the upper support.

* * * * *